US010429153B2

(12) United States Patent
Gorham

(10) Patent No.: US 10,429,153 B2
(45) Date of Patent: Oct. 1, 2019

(54) PERSONAL DEFENSE DEVICE

(71) Applicant: Robert Gorham, Louisville, KY (US)

(72) Inventor: Robert Gorham, Louisville, KY (US)

( * ) Notice: Subject to any disclaimer, the term of this patent is extended or adjusted under 35 U.S.C. 154(b) by 0 days.

(21) Appl. No.: 14/726,114

(22) Filed: May 29, 2015

(65) Prior Publication Data

US 2016/0349017 A1 Dec. 1, 2016

(51) Int. Cl.

| | |
|---|---|
| ***F41H 9/10*** | (2006.01) |
| ***G08B 15/02*** | (2006.01) |
| *G08B 3/10* | (2006.01) |

(52) U.S. Cl.

CPC ..... *F41H 9/10* (2013.01); *G08B 15/02* (2013.01); *G08B 3/10* (2013.01)

(58) Field of Classification Search

CPC ..... F41H 9/10; G08B 21/02; G08B 3/06
See application file for complete search history.

(56) References Cited

U.S. PATENT DOCUMENTS

| | | | | |
|---|---|---|---|---|
| 4,044,712 | A * | 8/1977 | Goodman | G08B 3/06 116/112 |
| 4,223,804 | A * | 9/1980 | Morris | B65D 83/201 116/214 |
| 5,549,220 | A * | 8/1996 | Whalen | B05B 9/0805 116/81 |
| 5,556,003 | A | 9/1996 | Johnson | |
| 5,859,588 | A | 1/1999 | Malone | |
| 6,052,051 | A * | 4/2000 | Whalen | F41H 9/10 222/1 |
| 7,121,432 | B2 * | 10/2006 | Kostal | F41H 9/10 222/192 |
| 8,690,020 | B1 * | 4/2014 | Murray | F41H 9/10 222/113 |
| 2004/0046669 | A1 * | 3/2004 | Chiapperini | F41H 9/10 340/574 |
| 2007/0194048 | A1 * | 8/2007 | Teig | F21V 33/0076 222/113 |
| 2007/0205223 | A1 | 9/2007 | Hansen | |
| 2010/0237103 | A1 * | 9/2010 | Habermann | F41H 9/10 222/183 |
| 2011/0210146 | A1 * | 9/2011 | Dapper | F41H 9/10 222/113 |
| 2012/0298776 | A1 * | 11/2012 | Yu | F41H 9/10 239/311 |
| 2014/0252027 | A1 * | 9/2014 | Lord | F41H 9/10 222/79 |
| 2014/0263445 | A1 * | 9/2014 | Rowlett | F41H 9/10 222/113 |
| 2016/0349017 | A1 * | 12/2016 | Gorham | F41H 9/10 |

* cited by examiner

*Primary Examiner* — David P Angwin
*Assistant Examiner* — Bob Zadeh
(74) *Attorney, Agent, or Firm* — The Law Offices of Eric W. Peterson

(57) ABSTRACT

A personal defense device for being used during an attack having a defense component having a defense member and an aerosol directing system, an alarm component having an alarm member and an alarm directing system, and a housing where the housing is capable of receiving the defense component and the alarm component, the defense component is capable of emitting a self-defense aerosol, and the alarm component is capable of emitting an alarm signal.

25 Claims, 8 Drawing Sheets

PERSONAL DEFENSE DEVICE

BACKGROUND

Self-defense spray devices are used to spray a caustic spray to defend against an attack. Air-horn can also be used to generate a loud sound to deter an attack and/or notify persons in close proximity to an attack that an attack is occurring. Simultaneous use of both a conventional self-defense spray device and an air-horn requires two-handed operation and can be clumsy to operate and is unrealistic to simultaneously operate both devices during an attack.

SUMMARY OF THE INVENTION

The present disclosure pertains to a personal defense device for being used during an attack having a defense component having a defense member and an aerosol directing system, an alarm component having an alarm member and an alarm directing system, and a housing where the housing is capable of receiving the defense component and the alarm component, the defense component is capable of emitting a self-defense aerosol, and the alarm component is capable of emitting an alarm signal.

One aspect of the disclosure is a personal defense device where the alarm directing system is capable of directing the alarm signal. Another aspect of the disclosure is a personal defense device where the aerosol directing system is capable of directing the self-defense aerosol. Another aspect of the disclosure is a personal defense device where the alarm directing system and aerosol directing system penetrate the same side of the housing. Another aspect of the disclosure is a personal defense device where the defense member and the alarm member are positioned in a single file orientation. Another aspect of the disclosure is a personal defense device where the defense member and the alarm member are positioned in a side by side orientation. Another aspect of the disclosure is a personal defense device where the housing comprises a defense cavity for receiving the defense member and an alarm cavity for receiving the alarm member.

Another aspect of the disclosure is a personal defense device where the aerosol directing system comprises an aerosol passageway capable of allowing self-defense aerosol to pass therethrough. Another aspect of the disclosure is a personal defense device where the alarm directing system comprises a signal passageway capable of allowing an alarm signal to pass therethrough.

Another aspect of the disclosure is a personal defense device having an actuator button capable of activating the defense member and the alarm member. Another aspect of the disclosure is a personal defense device having: an activating member capable of activating the alarm member, where the alarm directing system has a signal passageway, the actuator button engages the signal passageway, and the activating member touches the signal passageway. Another aspect of the disclosure is a personal defense device where by applying a force to the actuator button the defense member and alarm member are activated.

Another aspect of the disclosure is a personal defense device by applying a force to the actuator button, the alarm member is activated, a force is applied to the signal passageway, the signal passageway applies a force to the defense member and the defense member is activated. Another aspect of the disclosure is a personal defense device having: an activating riser, where the activating riser engages the signal passageway and the activating member touches the activating riser. Another aspect of the disclosure is a personal defense device where by applying a force to the actuator button, the alarm member is activated, a force is applied to the signal passageway, the signal passageway applies a force to the activating riser, the activating riser applies a force to the defense member and the defense member is activated.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

In the following detailed description, reference is made to the accompanying drawings which form a part hereof and in which is shown by way of illustration specific embodiments in which the invention may be practiced. These embodiments are described in sufficient detail to enable those skilled in the art to practice the invention, and it is to be understood that other embodiments may be utilized and that structural or logical changes may be made without departing from the scope of the present invention. The following detailed description is, therefore, not to be taken in a limiting sense, and the scope of the present invention is defined by the appended claims.

The present disclosure pertains to personal defense device 100 for defending against an attacker and/or notifying a person of an emergency. In one embodiment, the personal defense device 100 can have a defense component, an alarm component, and a housing 200.

Figure 1:
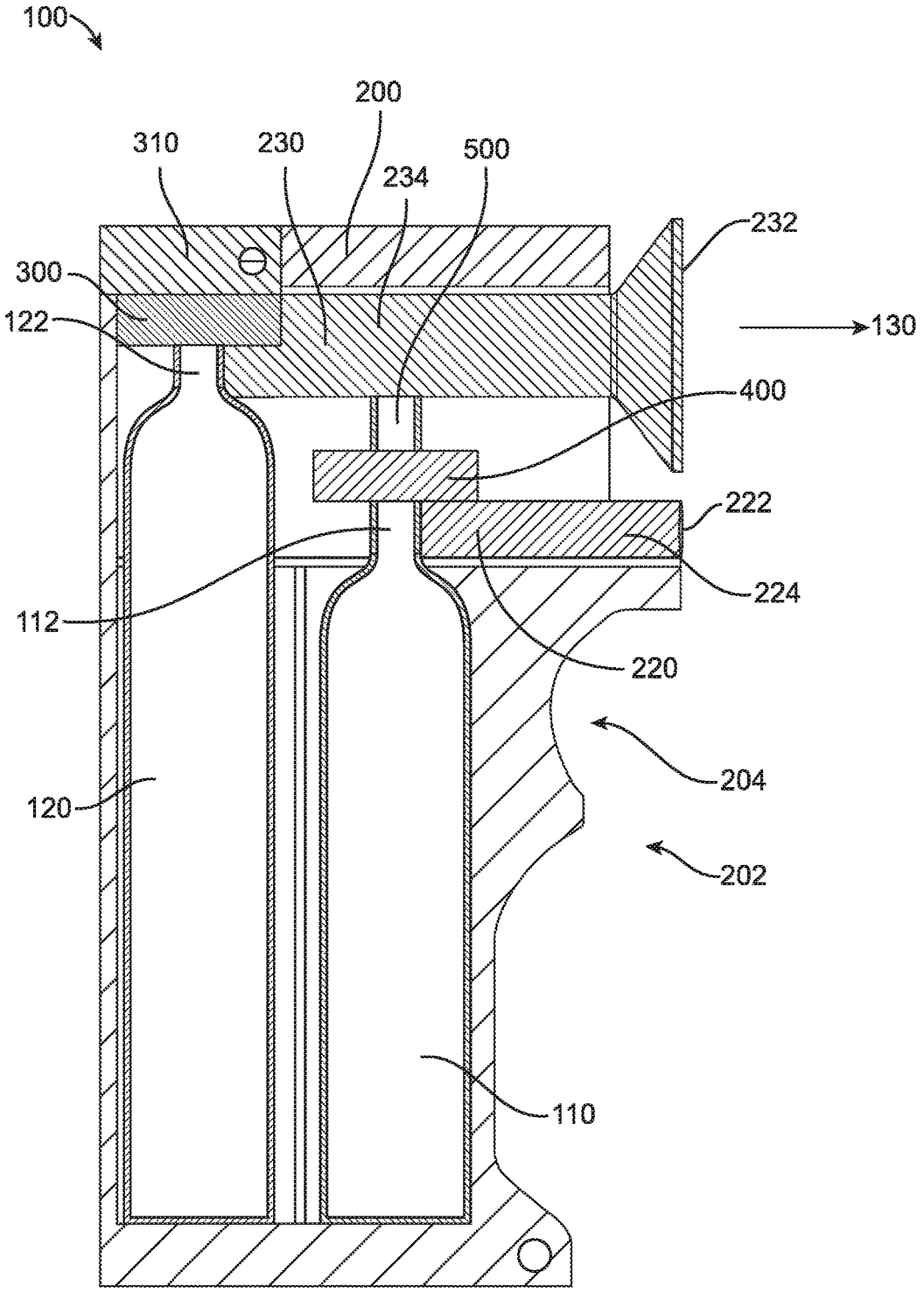
FIG. 1 is a cross-sectional view of a personal defense device according to an exemplary embodiment.
Figure 2:
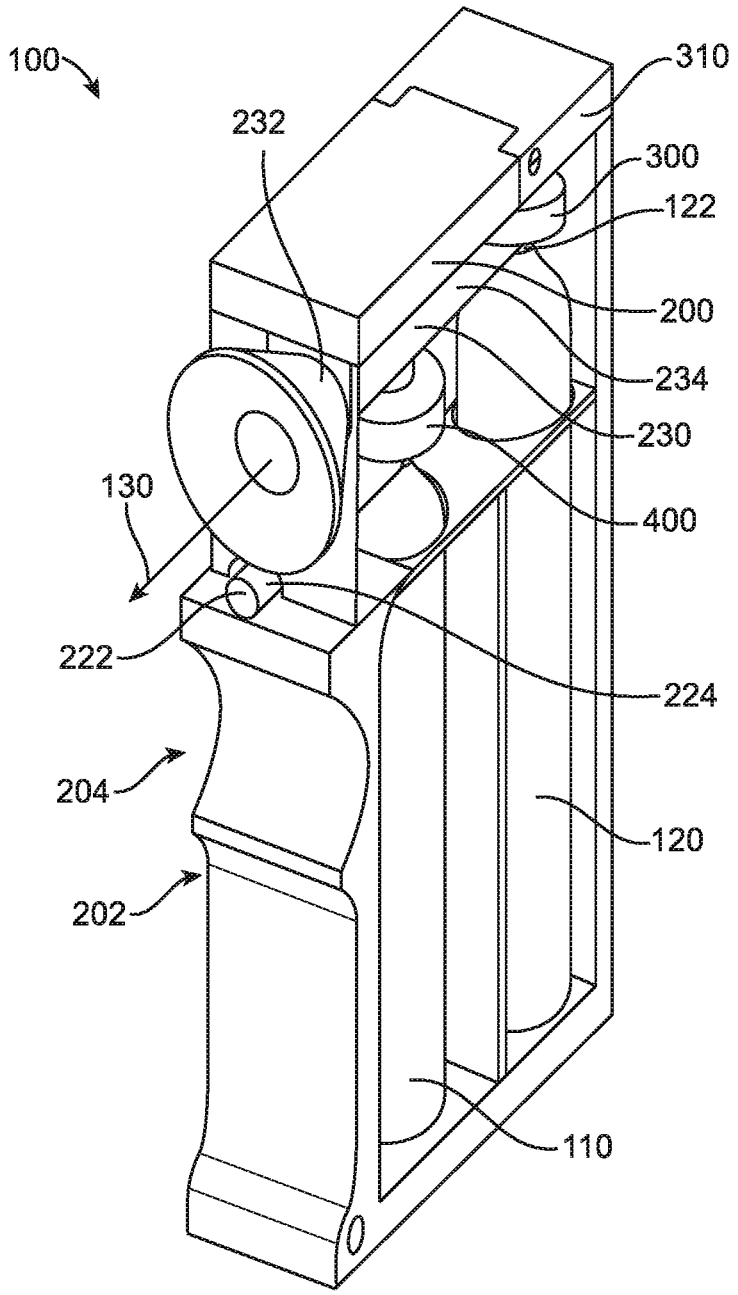
FIG. 2 is a perspective view of a personal defense device according to an exemplary embodiment.
Figure 3:
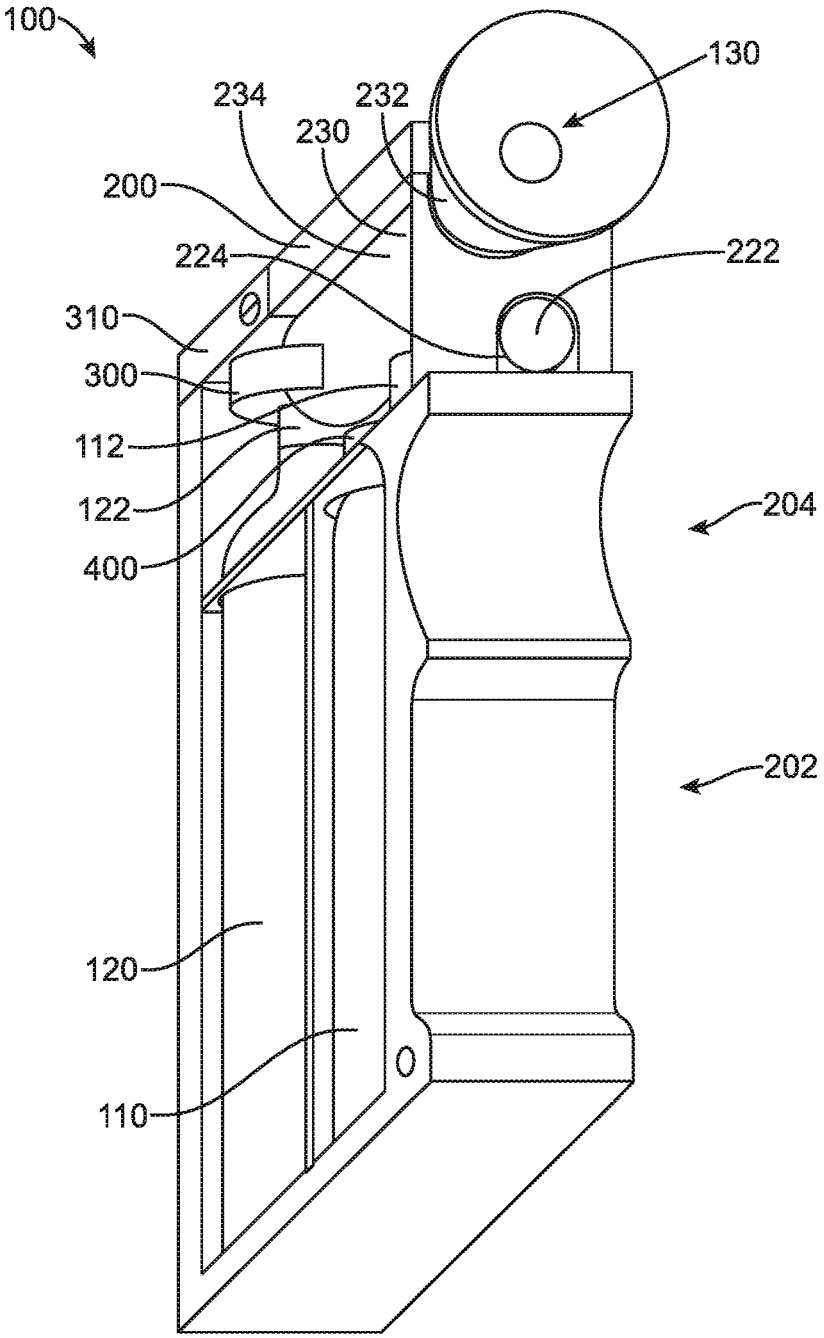
FIG. 3 is a perspective view of a personal defense device according to an exemplary embodiment.
Figure 4:
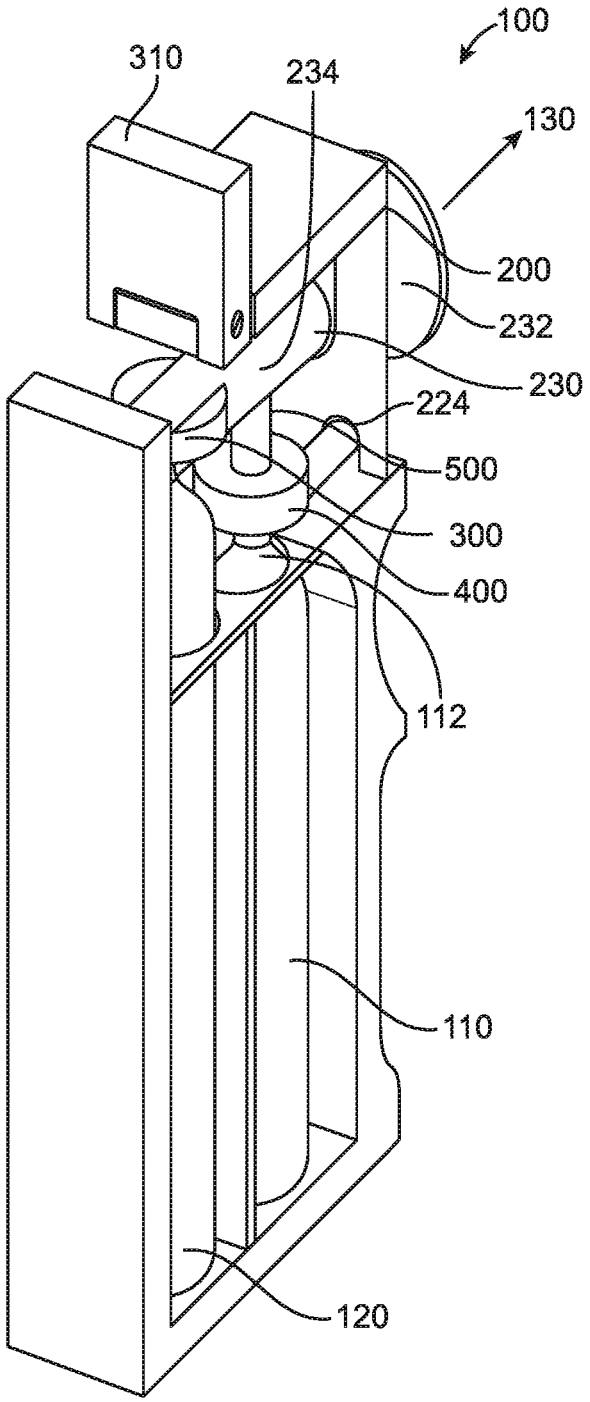
FIG. 4 is a perspective view of a personal defense device according to an exemplary embodiment.

As shown in FIG. 1, the defense component can have a defense member 110 to repel or disable an attacker by causing bodily discomfort or harm to an attacker to stop an attack. In one embodiment, the defense member 110 can be an aerosol canister containing a pressurized self-defense aerosol. Self-defense aerosol can be tear gas, pepper spray, or other spray aerosol which repels or deters an attacker. In one embodiment, the self-defense aerosol can have a propellant. The defense member 110 can have a release valve 112 adjacent its top end for discharging self-defense aerosol.

The defense member 110 can be activated upon pressure being applied to the top of the release valve 112 of the defense member 110.

The alarm component can have an alarm member 120 to emit an alarm signal alerting others that an emergency is occurring. In one embodiment, alarm member 120 can be an air canister containing pressurized air. The alarm member 120 can have a release valve 122 adjacent its top end for discharging air. The alarm member 120 can be activated upon pressure being applied to the top of the release valve 122 of the alarm member 120.

The housing 200 can couple the defense component with the alarm component. In one embodiment, the housing 200 can couple the defense member 110 with the alarm member 120. The housing 200 can receive the defense member 110 and the alarm member 120. The housing 200 can engage the defense member 110 and the alarm member 120. The housing 200 engages the defense member 110 and alarm member 120 in a manner that the defense member 110 and alarm member 120 are positioned adjacent or in close proximity. In one embodiment, the housing 200 can have a gripping area 202 having an at least one concave depression 204 for receiving fingers thereby allowing the user to grip the housing 200.

In one embodiment, defense member 110 releaseably engages the housing 200. The defense member 110 releaseably engages housing 200 so that it can be replaced when the self-defense aerosol is expended or the personal defense device 100 is not in use. The housing 200 can have a divider 240 for defining a defense cavity 210 which receives the defense member 110.

Figure 5:
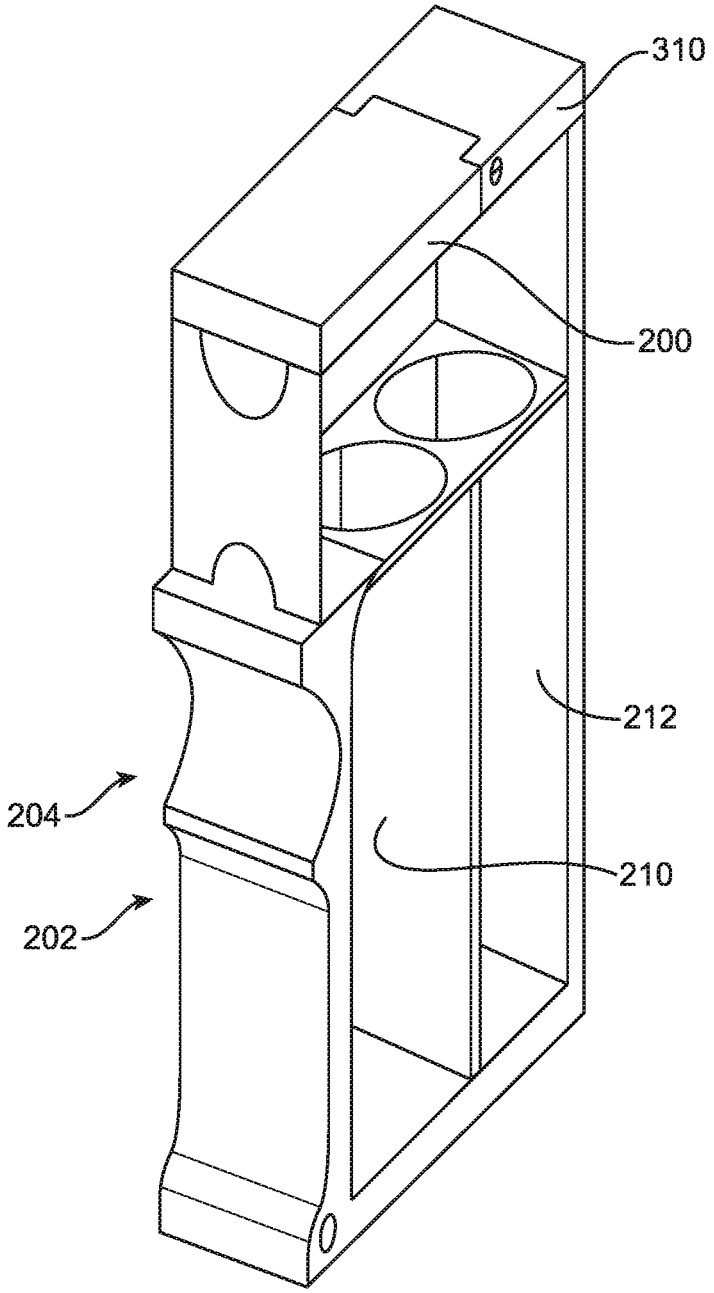
FIG. 5 is a perspective view of a housing according to an exemplary embodiment.

In one embodiment, alarm member 120 releaseably engages the housing 200. The alarm member 120 releaseably engages the housing 200 so that it can be replaced when the air is expended or the personal defense device 100 is not in use. As shown in FIG. 5, the housing 200 and divider 240 define an alarm cavity 212 which receives the alarm member 120.

Figure 6:
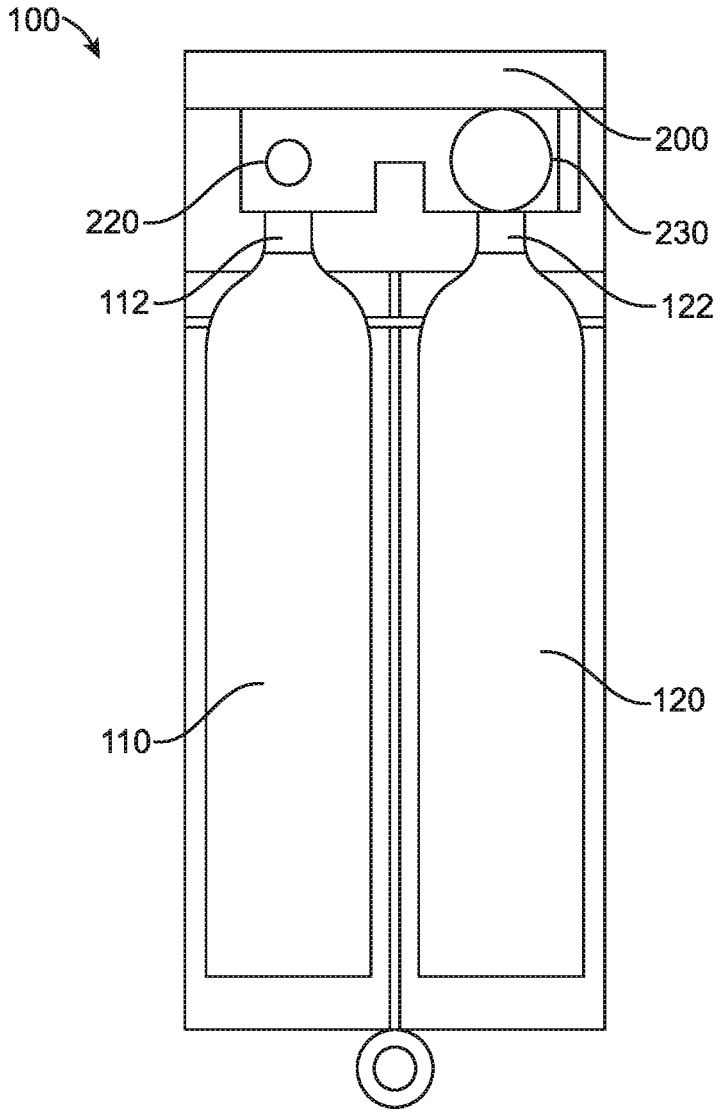
FIG. 6 is a side view of a personal defense device according to an exemplary embodiment.
Figure 7:
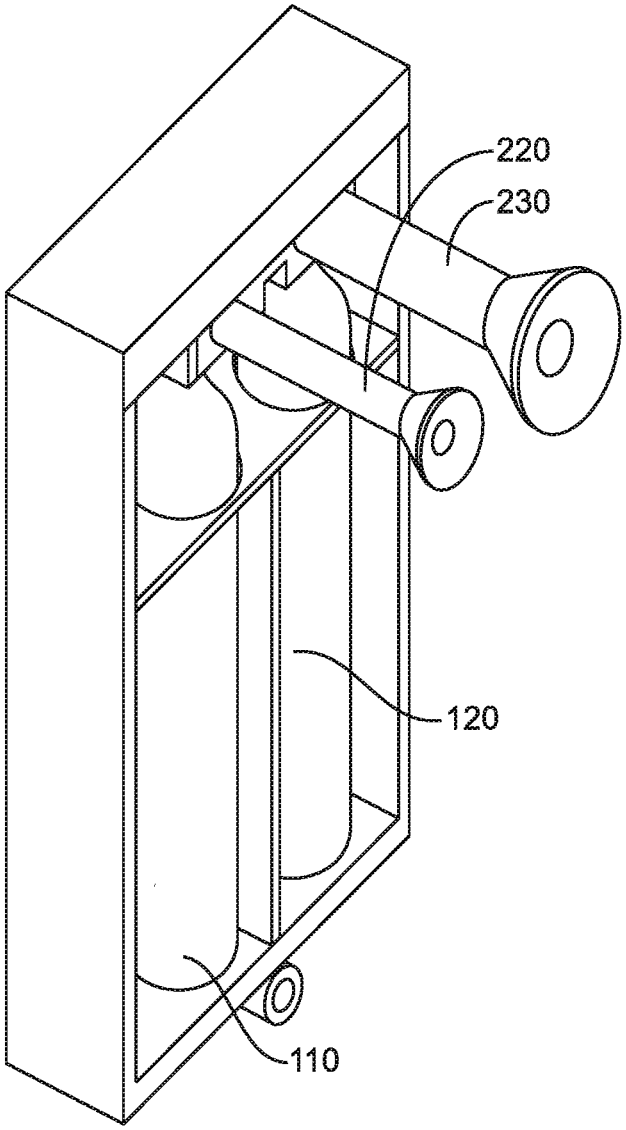
FIG. 7 is a perspective view of a personal defense device according to an exemplary embodiment.
Figure 8:
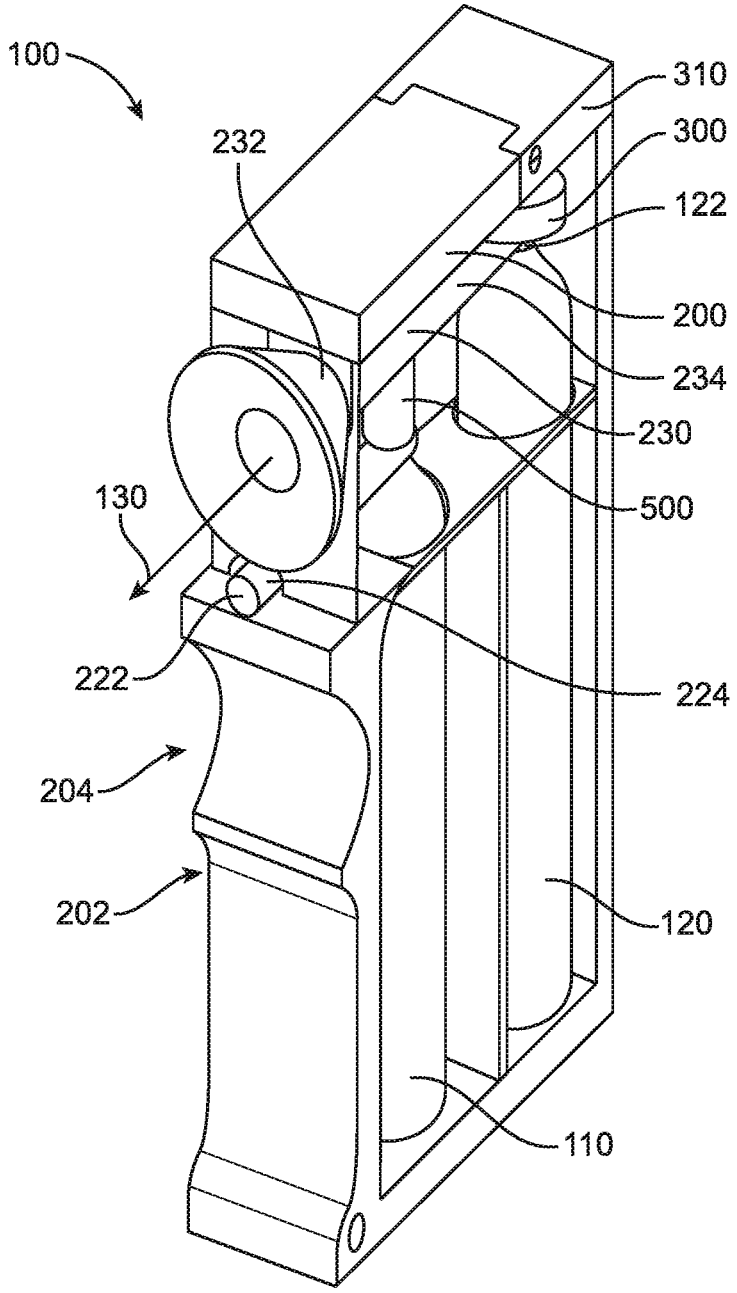
FIG. 8 is a perspective view of a personal defense device according to an exemplary embodiment.

In one embodiment, the defense member 110 and alarm member 120 are positioned in a single filed orientation. Where the defense member 110 and alarm member 120 are positioned in the single filed orientation, as shown in FIG. 1, the alarm member 120 can be positioned towards the back of the defense member 110. In one embodiment, the alarm member 120 is larger in size than the defense member 110. In one embodiment, as shown in FIG. 6-7, the defense member 110 and alarm member 120 can be positioned in a side by side orientation.

In one embodiment, as shown in FIGS. 1-4, the defense component can have an aerosol directing system 220 for directing the self-defense aerosol from the defense member 110 to the exterior of the personal defense device 100. In one embodiment, the aerosol directing system 220 directs the self-defense aerosol in direction 130. The aerosol directing system 220 engages the defense member 110. In one embodiment, the aerosol directing system 220 can have a nozzle 222 and an aerosol passageway 224 where the aerosol passageway 224 engages the defense member 110 and the nozzle 222 engages the aerosol passageway 224. The nozzle 222 is the outlet through which the self-defense aerosol passes when exiting the personal defense device 100. In one embodiment, the aerosol passageway 224 directs the self-defense aerosol from the defense member 110 to the nozzle 222 when defense member 110 is activated.

In one embodiment, as shown in FIGS. 1-4, the alarm component can have an alarm directing system 230 for directing the alarm signal from the alarm member 120 to the exterior of the personal defense device 100. The alarm signal can be an audible signal, visible signal, or the like. The alarm directing system 230 can have a horn bell 232 and a signal passageway 234 where the signal passageway 234 engages the alarm member 120 and the horn bell 232 engages the signal passageway 234. The horn bell 232 is the outlet through which the alarm signal passes when exiting the personal defense device 100. The alarm directing system 230 is capable of producing an audible sound in response to the air being released from the alarm member 120. The audible sound can be loud to deter an attack and/or notify people far away of an emergency. In one embodiment, the alarm directing system 230 is positioned above the defense member 110.

In one embodiment, the nozzle 222 and horn bell 232 are position to allow for the alarm signal and the self-defense aerosol to be directed in a predetermined direction. In one embodiment, the predetermined direction is direction 130. In one embodiment, the aerosol direction system 220 and alarm directing system 230 penetrate or pass through the same side of the housing 200. In one embodiment, the aerosol direction system 220 and alarm directing system 230 penetrate or pass through the front surface or side of the housing 200. The alarm signal and self-defense aerosol can be directed to exit the personal defense device 100 in the same predetermined direction so both can be directed towards an attacker.

In one embodiment, as shown in FIGS. 1-4, the personal defense device 100 can have an actuator button 300. The actuator button 300 can activate both defense member 110 and/or alarm member 120. In one embodiment, the actuator button 300 activates defense member 110 and alarm member 120 simultaneously. The actuator button 300 has at least two positions, an ON position and an OFF position. When the actuator button 300 is in the OFF position, neither defense member 110 nor alarm member 120 are activated. When the actuator button 300 is in the ON position, the defense member 110 and/or alarm member 120 are activated.

The actuator button 300 can have any form for activating a defense member 110 and/or alarm member 120, for example, without limitation, an electrical actuator, mechanical actuator, or the like. The actuator button 300 can be any type of actuator mechanism with at least two positions for example, without limitation, an ON position and an OFF position, where alarm member 120 and/or defense member 110 are activated or deactivated in response to the position of the actuator button 300. In one embodiment, the actuator button 300 is a mechanical actuator requiring pressure to be applied to the actuator button 300 to activate the actuator button 300. For example, without limitation, when pressure, for example, by way of a finger, is applied to the top of the actuator button 300, actuator button 300 is placed in an ON position and pressure is applied to the release valve 112 of the alarm unit and/or the release valve 112 of the defense member 110, thereby activating alarm member 120 and/or defense member 110. In this embodiment, actuator button 300 remains in the ON position while pressure continues to be applied to the actuator button 300. Upon releasing the pressure, actuator button 300 returns to the OFF position.

The actuator button 300 can be positioned above the release valve 112 of the defense member 110 and/or the release valve 122 of the alarm member 120. In one embodiment, the actuator button 300 can be positioned between the actuator button cover 310 and the release valve 112 of the defense member 110 and/or the release valve 122 of the alarm member 120. The actuator button 300 can be molded into a component of the personal defense device 100, for example, without limitation, the housing 200. Upon applying pressure to the actuator button 300, the force of the pressure causes the activating member 400 to be positioned in the ON position and activates the release valve 112 of the defense member 110 and/or the release valve 122 of the alarm member 120.

In one embodiment, as shown in FIGS. 1-4, the personal defense device 100 can have an activating member 400 for activating the alarm member 120 or the defense member 110. The activating member 400 has at least two positions, an ON position and an OFF position. When the activating member 400 is in the OFF position, neither defense member 110 nor alarm member 120 is activated. When the activating member 400 is in the ON position, the defense member 110 or alarm member 120 is activated.

The activating member 400 can have any form for activating a defense member 110 or alarm member 120, for example, without limitation, an electrical activating member, mechanical activating member, or the like. The activating member 400 can be any type of actuator mechanism with at least two positions for example, without limitation, an ON position and an OFF position, where alarm member 120 and/or defense member 110 are activated or deactivated in response to the position of the activating member 400. In one embodiment, the activating member 400 is a mechanical activating member 400 requiring pressure to be applied to the activating member 400 to activate the activating member 400. For example, without limitation, when pressure, for example, by way of another component of the personal defense device 100, is applied to the top of the activating member 400, activating member 400 is placed in an ON position and applies pressure to the release valve 122 of the alarm member 120 or the release valve 112 of the defense member 110, thereby activating alarm member 120 or defense member 110. In this embodiment, activating member 400 remains in the ON position while pressure continues to be applied to the activating member 400. Upon releasing the pressure, activating member 400 returns to the OFF position.

The activating member 400 can be positioned above the release valve 112 of the defense member 110 or the release valve 122 of the alarm member 120. In one embodiment, the activating member 400 can be positioned between the signal passageway 234 and the release valve 112 of the defense member 110. The activating member 400 can be molded into a component of the personal defense device 100, for example, without limitation, the signal passageway 234, or can be an independent or stand-alone component. In one embodiment, the alarm directing system 230 is positioned above the defense member 110 and the activating member 400 can be engaged to or touching the under surface of the signal passageway 234. Upon applying pressure to the actuator button 300, the force of the pressure is transferred from the actuator button 300, onto the signal passageway 234 and onto the activating member 400 thereby causing the activating member 400 to be positioned in the ON position and activating the release valve 112 of the defense member 110 or the release valve 122 of the alarm member 120.

In one embodiment, as shown in FIGS. 1-4, the personal defense device 100 can have an activating riser 500 for aiding in the activation of the release valve 112 of the defense member 110 and/or the release valve 122 of the alarm member 120. The activating riser 500 can be positioned above the activating member 400. In one embodiment, the activating riser 500 can be positioned between the signal passageway 234 and the activating member 400. The activating riser 500 can be molded into a component of the personal defense device 100, for example, without limitation, the signal passageway 234, or can be an independent or stand-alone component. In one embodiment, the alarm directing system 230 is positioned above the defense member 110 and the activating riser 500 can be engaged to the under surface of the signal passageway 234. Upon applying pressure to the actuator button 300, the force of the pressure is transferred from the actuator button 300, to the signal passageway 234, to the activating riser 500, and to the activating member 400 thereby causing the activating member 400 to be positioned in the ON position and activating the release valve 112 of the defense member 110 or the release valve 122 of the alarm member 120.

The actuator button 300 can be placed in the ON or, as shown in FIGS. 1-7, the OFF position. Actuator button 300 can be placed in the ON position when an attack or other emergency occurs. The defense member 110 is activated in response to the actuator button 300 being in the ON position. In one embodiment, when the defense member 110 is activated, self-defense aerosol is released from the defense member 110, passes through the aerosol directing system 220, and exists the personal defense device 100 through the nozzle 222. The self-defense aerosol can be sprayed in direction 130 toward the attacker, thereby deterring the attacker from continuing to carry out the attack.

The alarm member 120 is activated in response to actuator button 300 being in the ON position. In one embodiment, when the alarm member 120 is activated, compressed air is released from alarm member 120, passes through the alarm directing system 230, and exits the personal defense device 100 through the horn bell 232, thereby creating an alarm signal. The alarm directing system 230 directs the alarm signal in direction 130. The alarm signal created by the air exiting the horn bell 232 can disrupt the attacker and notify other people nearby of the attack thereby deterring the attacker from continuing to carry out the attack.

In one embodiment, as shown in FIGS. 1-4, the housing 200 can have an actuator button cover 310. The actuator button cover 310 protects the actuator button 300 from getting bumped, broken, or accidentally placed in the ON position. The actuator button cover 310 can prevent pressure from being applied to the actuator button 300 thereby preventing the actuator button 300 from being positioned in the ON position. Actuator button cover 310 can be a door or latch positioned above or on top of the actuator button 300 where, when the actuator button cover 310 is in the closed state, the actuator button cover 310 prevents the actuator button 300 from being positioned in the ON position and, when the actuator button cover 310 is in the open state, the actuator button cover 310 allows for the actuator button 300 to be positioned in the ON position. In one embodiment, the actuator button cover 310 is incorporated into the housing 200. The actuator button cover 310 can rotationally or slideably engage the housing 200, whereby, for example without limitation, the actuator button cover 310 is rotated about a hinge, the actuator button cover 310 opens thereby allowing the user access to the actuator button 300.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

Modifications and variations of the present invention are possible in light of the above teachings. It is therefore to be understood that the invention may be practiced otherwise than as specifically described herein.

What is claimed is:

1. A personal defense device for being used during an attack comprising:

a defense component having a defense member and an aerosol directing system, the aerosol directing system having an aerosol passageway configured to activate the defense member, an alarm component having an alarm member and an alarm directing system, the alarm directing system having a signal passageway, an actuator button configured to activate the defense member and the alarm member, an activating riser, and a housing, wherein the aerosol passageway engages the defense member, wherein the aerosol passageway engages the activating riser, wherein the activating riser directly touches the signal passageway, wherein the housing is configured to receive the defense component and the alarm component, wherein the defense component is configured to emit a self-defense aerosol, and wherein the alarm component is configured to emit an alarm signal.

2. The personal defense device of claim 1 wherein the alarm directing system is capable of directing the alarm signal.

3. The personal defense device of claim 1 wherein the aerosol directing system is capable of directing the self-defense aerosol.

4. The personal defense device of claim 1 wherein the alarm directing system and aerosol directing system penetrate a same side of the housing.

5. The personal defense device of claim 1 wherein the defense member and the alarm member are positioned in a single file orientation.

6. The personal defense device of claim 1 wherein the defense member and the alarm member are positioned in a side by side orientation.

7. The personal defense device of claim 1 wherein the housing comprises a defense cavity for receiving the defense member and an alarm cavity for receiving the alarm member.

8. The personal defense device of claim 1 wherein by applying a force to the actuator button the defense member and alarm member are activated.

9. The personal defense device of claim 8 wherein by applying a force to the actuator button, the alarm member is activated, a force is applied to the signal passageway, the signal passageway applies a force to the activating riser, the activating riser applies a force to the defense member and the defense member is activated.

10. The personal defense device of claim 1 further comprising an activating member.

11. The personal defense device of claim 10 wherein by applying a force to the actuator button, the alarm member is activated, a force is applied to the signal passageway, the signal passageway applies a force to the activating riser, the activating riser applies a force to the activating member, the activating member applies a force to the defense member and the defense member is activated.

12. A personal defense device for being used during an attack comprising:

a defense component having a defense member and an aerosol directing system, the aerosol directing system having an aerosol passageway configured to activate the defense member, an alarm component having an alarm member and an alarm directing system, the alarm directing system having a signal passageway, an actuator button configured to simultaneously activate the defense member and the alarm member, an activating member capable of activating the defense member, an activating riser, and a housing, wherein the aerosol passageway engages the defense member, wherein the actuator button engages the signal passageway, wherein the activating member touches the aerosol passageway, wherein the activating riser touches the activating member, wherein the housing is configured to receive the defense component and the alarm component, wherein the defense component is configured to emit a self-defense aerosol, and wherein the alarm component is configured to emit an alarm signal.

13. The personal defense device of claim 12 wherein the alarm directing system is capable of directing the alarm signal.

14. The personal defense device of claim 12 wherein the aerosol directing system is capable of directing the self-defense aerosol.

15. The personal defense device of claim 12 wherein the alarm directing system and aerosol directing system penetrate a same side of the housing.

16. The personal defense device of claim 12 wherein the defense member and the alarm member are positioned in a single file orientation.

17. The personal defense device of claim 12 wherein the defense member and the alarm member are positioned in a side by side orientation.

18. The personal defense device of claim 12 wherein the housing comprises a defense cavity for receiving the defense member and an alarm cavity for receiving the alarm member.

19. The personal defense device of claim 12 wherein by applying a force to the actuator button the defense member and alarm member are activated.

20. The personal defense device of claim 12 wherein by applying a force to the actuator button, the alarm member is activated, a force is applied to the signal passageway, the signal passageway applies a force to the defense member and the defense member is activated.

21. The personal defense device of claim 12 wherein the defense member and alarm member are activated by the actuator button receiving a force and transferring the force to the defense member and alarm member.

22. The personal defense device of claim 12 wherein all portions of the actuator button are positioned above both the alarm member and defense member.

23. The personal defense device of claim 12 wherein the alarm signal is an audible sound in response to air being released from the alarm member and wherein the signal passageway is a tunnel through which the alarm signal passes.

24. The personal defense device of claim 12 wherein the signal passageway is configured to direct the alarm signal.

25. The personal defense device of claim 24 wherein the alarm signal is directed from the alarm member to the exterior of the housing.

* * * * *